US006030207A

United States Patent [19]

Saleri

[11] Patent Number: 6,030,207

[45] Date of Patent: Feb. 29, 2000

[54] GAS BURNER FOR DOMESTIC APPLIANCES

[75] Inventor: Giuseppe Saleri, Lumezzane, Italy

[73] Assignee: Sabaf S.p.A., Lumezzane, Italy

[21] Appl. No.: 09/166,874

[22] Filed: Oct. 6, 1998

[30] Foreign Application Priority Data

Oct. 8, 1997 [EP] European Pat. Off. ..... 97830502

[51] Int. Cl.[7] ..... F24C 3/08

[52] U.S. Cl. ..... 431/354; 126/39 R

[58] Field of Search ..... 431/266, 354, 431/355; 126/39 E, 39 R

[56] References Cited

U.S. PATENT DOCUMENTS

| | | | |
|---|---|---|---|
| 4,565,523 | 1/1986 | Berkelder . | |
| 4,886,043 | 12/1989 | Homer | 126/39 E |
| 5,139,417 | 8/1992 | Ghassemzadeh | 431/354 |
| 5,277,576 | 1/1994 | Hartung et al. | 126/39 R |

FOREIGN PATENT DOCUMENTS

| | | | |
|---|---|---|---|
| 2507743 | 12/1982 | France . | |
| 58-179716 | 10/1983 | Japan | 431/354 |
| 9606304 | 2/1996 | WIPO . | |

*Primary Examiner*—Ira S. Lazarus
*Assistant Examiner*—Sara Clarke
*Attorney, Agent, or Firm*—Cobrin & Gittes

[57] ABSTRACT

A burner for gas cookers that includes a body provided with at least one aperture that defines at least one concentric flame crown and a base fitted to a cooking hob. The burner has an interchangeable circumferential ring that is fitted to the body by a mechanical fixture, which increases diameter of the body in proximity of the base. The ring curves toward the cooking hob like an annular skirt to define a passage for use with burners which draw primary air from above the cooking hob.

10 Claims, 4 Drawing Sheets

GAS BURNER FOR DOMESTIC APPLIANCES

BACKGROUND OF THE INVENTION

1. Field of the Invention

The present invention relates to a burner for a gas-cooker with an interchangeable circumferential ring i.e. a burner in which the base ring can be replaced to adapt it to the requirements of the cooking hob on which it is fitted.

Gas burners for domestic use generally comprise a base element, comprising the gas injector, and the body of the burner, resting on the base element and forming a Venturi to mix the gas with the primary air, together with passages for the mixture up to the openings of the flame exits.

The primary air can be fed from under the cooking hob or (preferentially in the case of cooking hobs separated from the main body of the economic cooker) from above the cooking hob.

In the first case, the burner doesn't require any external element to convey the primary air and therefore the burner can have an essentially cylindrical external configuration with a vertical axis. An embodiment is known in which the cylindrical burner is surrounded by a sheet metal ring, generally curved in shape, which rests freely on the hob, has an ornamental function and can also help to prevent liquid from penetrating into the lower part of the cooker. As described, this ring is simply resting on the hob and therefore its axial and radial position with respect to the burner is always very approximate and unstable. In gas burners which collect the primary air from above the cooking hob, it is, however, necessary to convey the air toward the interior of the burner and an external circumferential ring is therefore provided, pressed as one piece with the body of the burner, which stretches toward the lower part in the direction of the cooking hob and forms with the latter, when the burner is fitted, a circumferential passage which admits the required primary air. This one-piece external ring, while fulfilling its own function effectively, has the disadvantage of constituting an aesthetically anomalous element on the cooking hob, which is generally enameled and colored, as the upper covers of the burners are also enameled and colored.

2. Objects of the Invention

Based on the above premises, it is now the principal purpose of the present invention to provide a burner with an external ring which can easily be adjusted to the aesthetic requirements of the different cooking hobs.

In the case of burners which collect air from above the cooking hob, the purpose of the invention is to provide a burner with external ring which adjusts to the aesthetic requirements of the different cooking hobs while always maintaining its own exactly defined functional characteristics, with the surface of the cooking hob, and a circumferential passage for the entry of the primary air toward the interior of the burner.

SUMMARY OF THE INVENTION

Such purpose is achieved by the present invention, which relates to a burner for gas cookers, comprising a body provided with one or more series of apertures which define one or more concentric flame crowns and a base fitted to the cooking hob, characterized by there being an interchangeable circumferential ring fitted to the said body by mechanical means of fixture, which acts to increase the diameter in proximity of the base.

Preferably, the ring circumferential is curved and turned toward the cooking hob, like an annular skirt, and is made of a different material than the body of the burner, in particular, though not exclusively, in enameled steel.

The burner according to the invention presents numerous advantages compared to the known technique. The skirt fitted to the base of the body allows the essential components of the burner to be produced as a single model and subsequently be modified on the basis of aesthetic requirements or at the request of the fitter of the cooking hob, in terms of shape, color, brightness etc. by applying different circumferential rings without any increase in the general cost of the burner and, in the case of collecting of the air above the cooking hob, maintaining the good operating characteristics of the one-piece burner and ring.

The invention will now be described in more detail, with reference to the enclosed table of sketches, which are illustrative, but not limiting, and in which:

DESCRIPTION OF THE PREFERRED EMBODIMENTS

Figure 1:
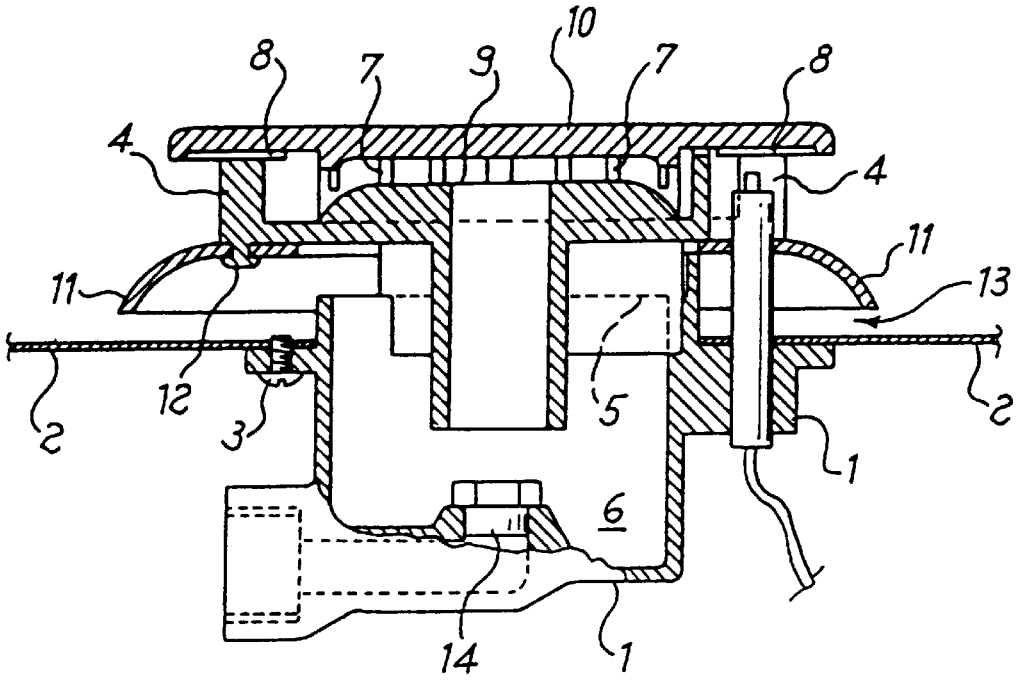
FIG. 1 is a vertical section of a burner fitted to the cooking hob, of the type which collects the primary air from above the cooking hob.
Figure 2:
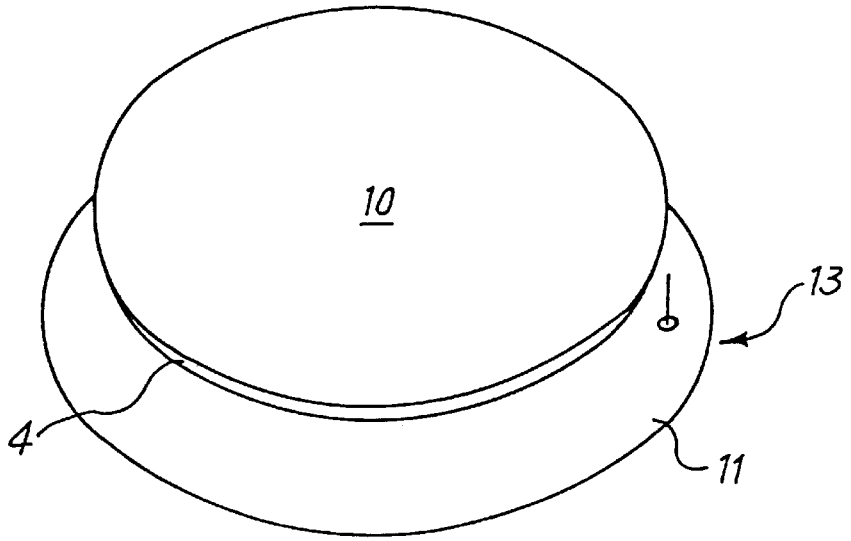
FIG. 2 is a prospective view of the burner complete with skirt.

As can be seen in FIG. 1, the base 1 of the burner is fitted to the cooking hob 2 by means of screws 3 and carries the gas injector 14. The body 4 is lodged in a very precise position on the upper edge 5 of the base, above the air/gas mixing chamber 6; the crown of slits 7 for the principal flames and apertures 8 for the pilot flames is in the upper part of the body. The distribution chamber 9 is closed above by the cover 10, which can form a horizontal Venturi with the body 4.

The skirt 11 can be fitted by means of screws, rivets or any other mechanical means, to the lower part of the body 4 and is shaped as a ring curving toward the cooking hob 2.

The cylindrical aperture 13 defines a constant section crossed by the primary air, which penetrates, into the mixing chamber 6 from the surface of the cooking hob 2.

Figure 3:
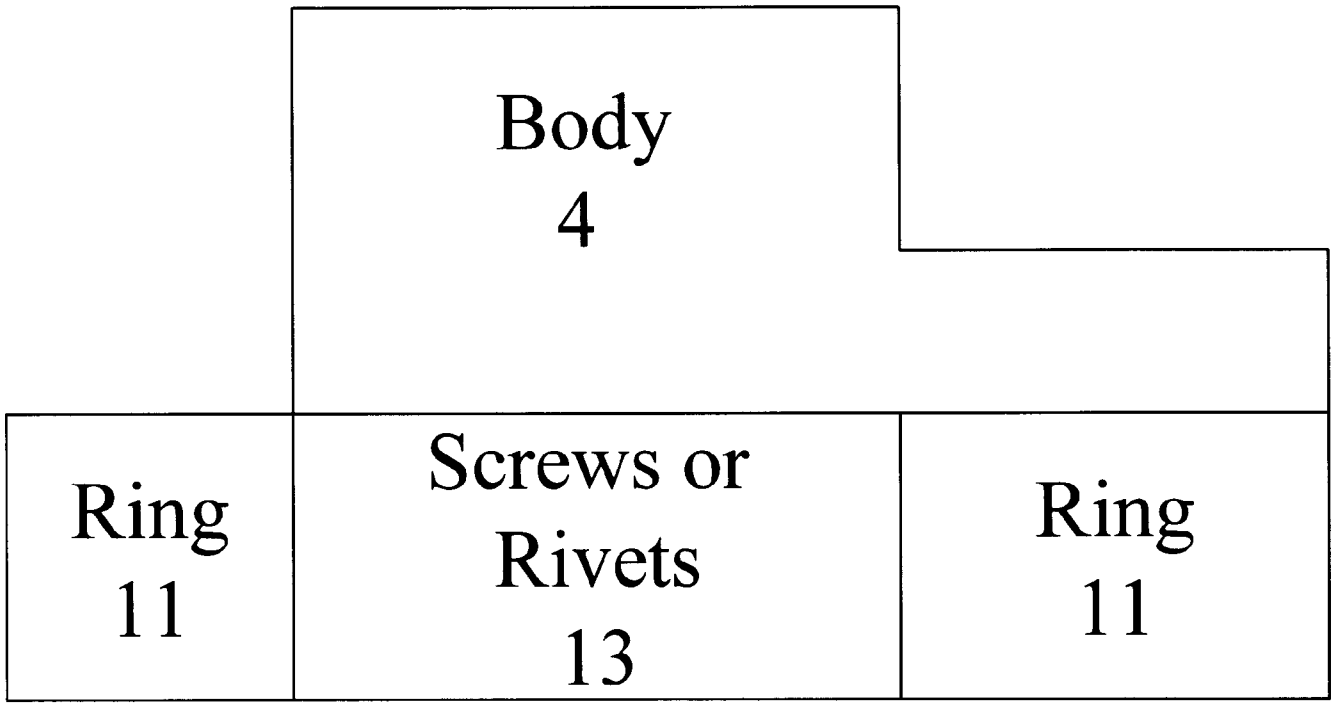
FIGS. 3–5 schematically show various mechanical fixtures used to secure the body and the interchangeable circumferential ring together.
Figure 4:
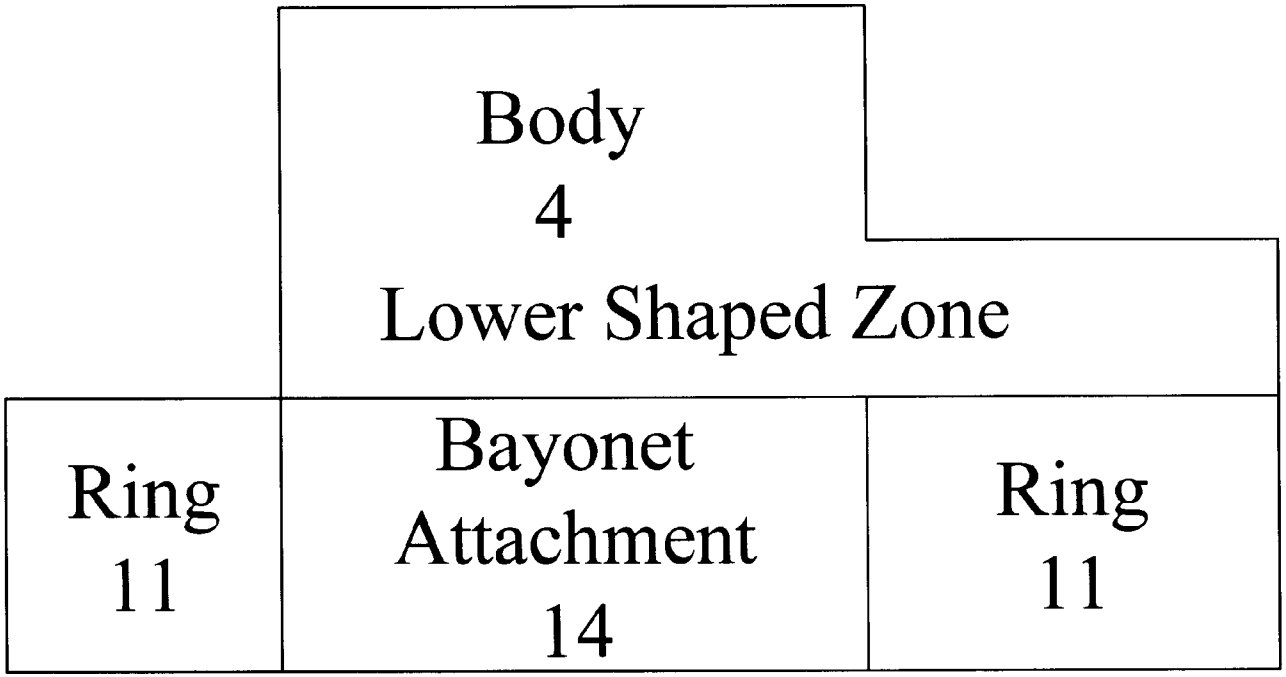
Figure 5:
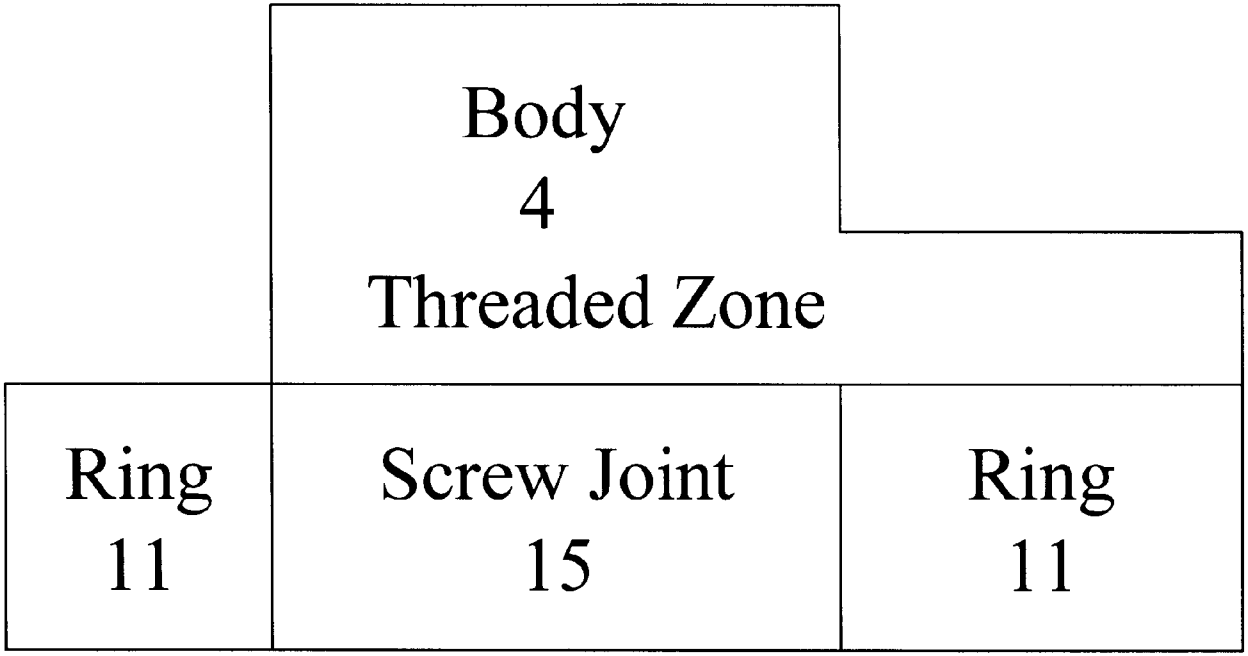

During assembly of the burner, the skirt 11 is fitted directly onto the under face of the body 4 by means of studs, screws, rivets, (13) shown in FIG. 3 as previously mentioned, or also by means of a locking engagement, e.g. bayonet joint (14) as shown in FIG. 4, or by screwing it with a screw joint (15) as shown in FIG. 5 onto a threaded area of the body of the burner.

In the particular case illustrated, projections 12 are provided, which are extensions from the lower part of the body of the burner 4 and engage in holes prepared in the ring 11 and are then riveted to fix the latter.

A generic domestic burner for gas-cookers is shown in the Figures of the type which collects the primary air from above the cooking hob, provided with a single flame crown, but obviously the skirt 11 can be fitted without distinction to the body of burners with two or more concentric flame crowns. This fitting has the advantage of further subdividing, and to a greater distance from the burner, the secondary air between that destined for the internal crown and that destined for the external flame crown.

The fitting to the body of the burner by mechanical means of an external ring or skirt in a material different from that of the burner, particularly though not exclusively in any enameled steel, allows not only the functional requirements, but also all the aesthetic requirements related to the configuration of this ring—its coloration, brightness and other—to be satisfied, thus giving burners which, while having a unified base and body, can also be adapted easily and at reduced cost to every aesthetic requirement of the consumers.

What is claimed is:

1. Burner for gas cookers, comprising a base (1) that defines an air/gas mixing chamber, a gas injector (14) arranged to inject gas into the chamber, a cooking hob (2), the base (1) being fitted to the cooking hob (2), an interchangeable circumferential ring (11), a body (4) provided with one or more series of apertures (7) defining a flame crown, the body (4) being fitted with the interchangeable circumferential ring (11), the interchangeable circumferential ring extending outwardly to a location spaced further outwardly than where cooking hob is fixed to the base, the circumferential ring, the cooking hob and the base being configured and arranged to define a passage (13) to the air/gas mixing chamber, the interchangeable circumferential ring having an outer edge arranged at an elevation above that of the cooking hob as the base is beneath the body and thereby being arranged to permit entry of primary air into the chamber from above the cooking hob.

2. A burner according to claim 1, characterized by the circumferential ring (11) being configured of a material that is different from a material of the body (4) of the burner.

3. The burner according to claim 2, characterized by the said circumferential ring (11) being in steel.

4. The burner according to claim 2, characterized by the said circumferential ring (11) being enameled.

5. A burner according to claim 1, characterized by the circumferential ring (11) having an axial section with a configuration substantially curved toward a lower part of the circumferential ring.

6. The burner according to claim 1, characterized by said mechanical fixture being constituted by projections (12) drawn of a piece in a lower zone of the body (4) of the burner, made to pass through holes prepared in the ring (11) and riveted.

7. The burner according to claim 1, characterized by said mechanical means of fixing (12) comprising screws or rivets fitted in a lower zone of the body (4) of the burner.

8. The burner, according to claim 1, characterized by said mechanical means of fixing (12) comprising a bayonet attachment or a screw joint in a lower shaped or threaded zone of the body (4) of the burner.

9. The burner according to claim 1, wherein said body (4) defines a distribution chamber (9), further comprising a cover (10) that closes the distribution chamber from above while the base (1) is arranged beneath the body (4), the cover (10) and the body (4) forming a horizontal Venturi therebetween in fluid communication with the distribution chamber, the air/gas mixture chamber being arranged in fluid communication with the horizontal Venturi via the distribution chamber (9).

10. The burner according to claim 1, wherein the body and the interchangeable circumferential ring are fixed together by a mechanical fixture (12).

* * * * *